US010188154B2

(12) United States Patent
Beattie et al.

(10) Patent No.: US 10,188,154 B2
(45) Date of Patent: Jan. 29, 2019

(54) BRASSIERE UNDERWIRE REPAIR DEVICE

(71) Applicants: Michael D. Beattie, Camden, NJ (US); Veronica A. Rucker, Pennsauken, NJ (US)

(72) Inventors: Michael D. Beattie, Camden, NJ (US); Veronica A. Rucker, Pennsauken, NJ (US)

( * ) Notice: Subject to any disclaimer, the term of this patent is extended or adjusted under 35 U.S.C. 154(b) by 69 days.

(21) Appl. No.: 15/597,165

(22) Filed: May 17, 2017

(65) Prior Publication Data

US 2017/0340025 A1 Nov. 30, 2017

Related U.S. Application Data

(60) Provisional application No. 62/392,397, filed on May 31, 2016.

(51) Int. Cl.
*A41C 3/12* (2006.01)

(52) U.S. Cl.
CPC ..... *A41C 3/126* (2013.01)

(58) Field of Classification Search
CPC ..... A41C 3/00; A41C 3/122; A41C 3/126; A41C 3/0007; A41C 3/12
USPC ..... 450/41, 52; 2/257, 244
See application file for complete search history.

(56) References Cited

U.S. PATENT DOCUMENTS

| | | | | |
|---|---|---|---|---|
| 4,133,316 | A * | 1/1979 | Schwartz | A41C 3/126 450/52 |
| 6,056,626 | A * | 5/2000 | Fildan | A41F 15/002 2/336 |
| 7,189,138 | B1 * | 3/2007 | Utaka | A41C 3/126 450/41 |
| 7,666,060 | B2 * | 2/2010 | Cheung | A41C 3/126 450/41 |
| 8,778,475 | B2 * | 7/2014 | Joyce | A41H 27/00 428/221 |
| 8,968,050 | B1 * | 3/2015 | Riley | A41C 3/126 2/244 |
| 2010/0242157 | A1 * | 9/2010 | Littell | A41C 3/12 2/257 |
| 2011/0034105 | A1 * | 2/2011 | Boser | A41C 3/122 450/41 |

* cited by examiner

*Primary Examiner* — Gloria Hale
(74) *Attorney, Agent, or Firm* — Stuart M. Goldstein

(57) ABSTRACT

A repair device that repairs a brassiere or similar garment with an underwire that has poked through its fabric casing. The repair device accommodates various thicknesses and shapes of underwire tips and is installed inside an underwire's fabric casing. This invention also includes a single use installation apparatus that enables and facilitates the installation of the repair device by reducing friction between the repair device and the inner surfaces of an underwire's fabric casing.

10 Claims, 6 Drawing Sheets

BRASSIERE UNDERWIRE REPAIR DEVICE

CROSS-REFERENCE TO RELATED APPLICATIONS

62/392,397

FEDERALLY SPONSORED RESEARCH

Not Applicable

SEQUENCE LISTING OR PROGRAM

Not Applicable

BACKGROUND OF THE INVENTION

This invention relates to brassieres or similar garments that use an underwire for support and stability. The problem that occurs with brassieres is once the underwire has poked through its fabric casing, the brassiere losses its support and becomes unstable which renders it useless. This problem that occurs with a brassiere's underwire is usually a result of normal wear and tear.

Some manufactures of brassieres have created solutions that should prevent an underwire from poking through its fabric casing, such as: [U.S. Pat. No. 7,189,138]-[U.S. Pat. No. 4,133,316]-[U.S. Pat. No. 7,666,060]. Also, inventors have created repair devices and methods such as: [U.S. Pat. No. 8,778,475]-[GB2458675]-[U.S. Pat. No. 8,968,050]-[U.S. Pat. No. 4,133,316] and [U.S. Pat. No. 6,056,624] but they were difficult to install, required sewing, required reinstallation after washing the brassiere, or altered the outer appearance of the brassiere.

Repairing a brassiere with an underwire that has poked through its fabric casing remains a problem that proved difficult to solve. There continues to be a great need and desire to repair a brassiere with an underwire that has poked through its fabric casing. Although inventions have been created to repair a brassiere with an underwire that has poked through its fabric casing, there has not been an invention that eliminates all the aforementioned issues associated with repairing a brassiere with an underwire that has poked through its fabric casing.

This invention repairs a brassiere with an underwire that has poked through its fabric casing and also eliminates the aforementioned issues associated with repairing an underwire that has poked through its fabric casing. The repair device of this invention accommodates various thicknesses and shapes of underwire tips and cradles a portion of the underwire. This invention also includes a single use installation apparatus that enables and facilitates the installation of the repair device.

The repair device attaches to the tip of an underwire and the underwire is easily inserted inside its fabric casing with the use of the single use installation apparatus. Once the single use installation apparatus is removed, the repair device is adhered to the inner surfaces of the underwire's fabric casing with the use of a hot dry iron. Once cooled, the repair device will remain adhered to the inner surfaces of the underwire's fabric casing and the brassiere can be worn. Additionally, the repair does not alter the outer appearance of the brassiere and the repaired brassiere will remain repaired after it has been washed.

The repair device has a sleeve incorporated into its design in order to cover the tip of an underwire and act as a shield to prevent the underwire from poking through its fabric casing. The sleeve of this repair device is formed into a capped and hollow elliptic cylinder and is made of brass, but can also be made of other metals, metal alloys, plastic, wire mesh, or from materials that contain nylon, polylactic acid or polyethylene. The outer surfaces of the sleeve are coated with an outer layer of thermal adhesive.

The single use installation apparatus created within this invention enables and facilitates the installation of the repair device by reducing friction between the repair device and the inner surfaces of an underwire's fabric casing. The single use installation apparatus is constructed of vinyl sheet but can also be constructed of siliconized paper, regular paper, cardboard, or sheet materials that contain polyethylene.

BACKGROUND OF INVENTION—OBJECTS AND ADVANTAGES

Several objects and advantages of this invention are:

1. The repair device will repair a brassiere with an underwire that has poked through its fabric casing.
2. The repair device accommodates various sizes of underwire tips
3. The single use installation apparatus enables and facilitates the installation of the repair device.
4. Sewing is not required in order to install the repair device.
5. Reinstallation of the repair device is not required after washing a repaired brassiere.
6. The repair device will extend the use of a brassiere.
7. The repair does not alter the outer appearance of the brassiere.

SUMMARY OF THE INVENTION

This invention consists of a repair device and a single use installation apparatus that repairs a brassiere or similar garment with an underwire that has poked through its fabric casing. The repair device installs easily, and within minutes a brassiere with an underwire that has poked through its fabric casing is repaired without sewing. The repair device covers the tip of an underwire and is inserted inside the underwire's fabric casing and then heated with a hot dry iron. Once heated, the repair device adheres to the inner surfaces of the underwire's fabric casing. The repair device does not alter the outer appearance of the brassiere because it is constructed to be concealed inside an underwire's fabric casing. Also, reinstallation of the repair device is not required after washing the repaired brassiere.

BRIEF DESCRIPTION OF THE DRAWINGS

FIG. 1 shows a perspective view of the first embodiment of the repair device which is formed into the shape of a capped and hollow elliptic cylinder and consists of thermal adhesive and a sleeve.

FIG. 2 shows a perspective view of the second embodiment of the repair device that is similar to the first embodiment but has an inner layer of thermal adhesive applied to the inner surfaces of the sleeve.

FIG. 3 shows a perspective view of the third embodiment of the repair device. This embodiment of the repair device is similar to the first embodiment but excludes the sleeve.

FIG. 5 shows the repair device being fitted over the tip of an underwire that has poked through its fabric casing and created a hole in the underwire's fabric casing.

FIG. 6 shows the repair device after it has been fitted over the tip of an underwire FIG. 7 shows the single use installation apparatus after it has been inserted inside the hole in an underwire's fabric casing. The single use installation apparatus surrounds a portion of the repair device and a portion of an underwire while they are inserted inside the underwire's fabric casing.

FIG. 8 shows the removal of the single use installation apparatus once the repair device and underwire have been inserted inside the underwire's fabric casing. Also shown is a peeled back section of, an underwire's fabric casing that reveals the inner surfaces of an underwire's fabric casing.

DRAWINGS—REFERENCE NUMERALS

Figure 1:
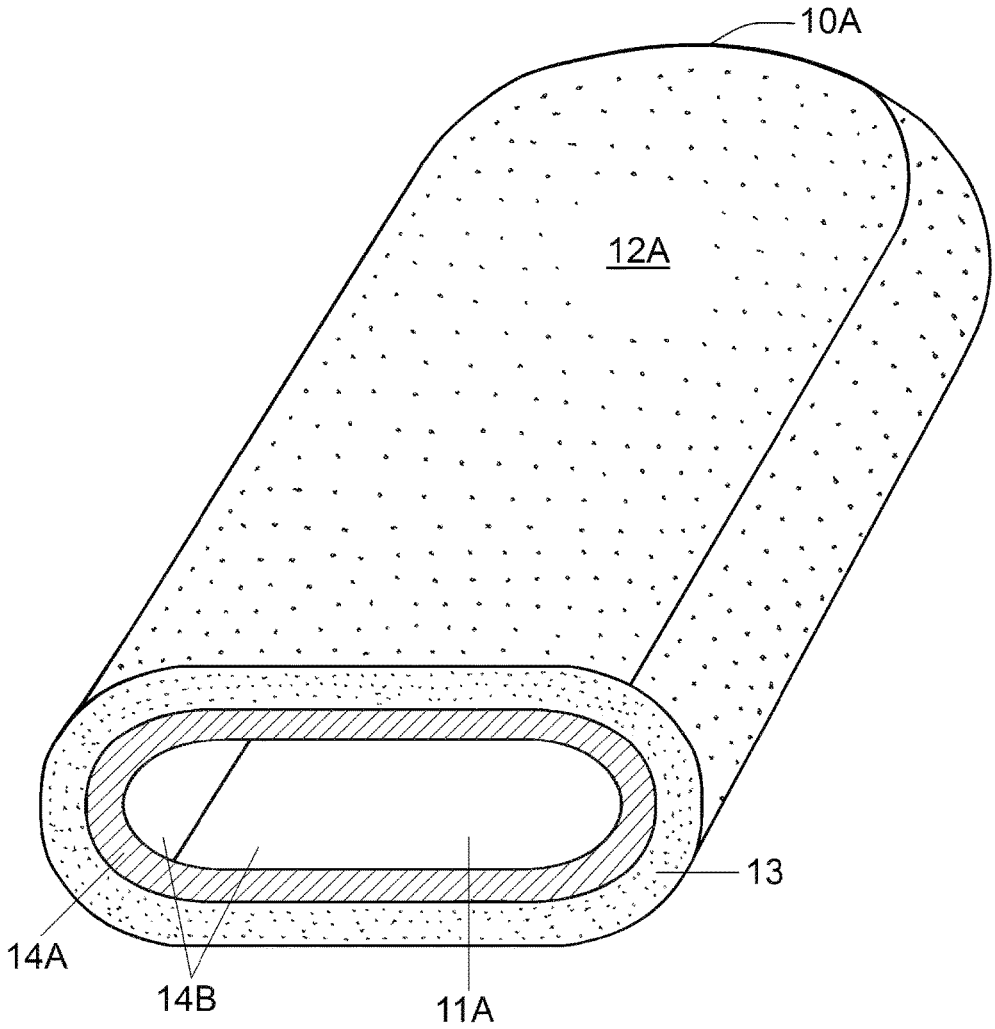
FIGS. 1, 2, 3 shows the embodiments of the repair device

| | | | |
|---|---|---|---|
| 10A | Top of the repair device | 10B | Top of the sleeve |
| 11A | Oval shaped opening of the sleeve | 11B | Oval shaped opening of the outer layer of thermal adhesive |
| 12A | Outer layer of thermal adhesive | 12B | Inner surfaces of the outer layer of thermal adhesive (Represents all) |
| 13 | Thickness of the outer layer of thermal adhesive | 14A | Sleeve (Represents) |
| 14B | Inner surfaces (Represents all) | 14C | Outer surfaces of the sleeve of the sleeve (Represents all) |
| 15 | Inner layer of thermal adhesive | 16 | Repair device |
| 17 | Single use installation apparatus | 18 | Tip |
| 19 | Underwire | 20 | Hole |
| 21 | Underwire's fabric casing | 22 | Inner surfaces of an underwire's fabric casing (Example) |

DETAILED DESCRIPTION OF THE INVENTION

The repair device of this invention is created to repair a brassiere with an underwire that has poked through its fabric casing. As shown in FIGS. 5,6,7 and 8 (left cup view from the inside of the brassiere) the repair device (16) is fitted over the tip (18) of an underwire (19) and is easily inserted inside the underwire's fabric casing (21) with the use of the single use installation apparatus (17). Once the repair device (16) and underwire (19) are inside the underwire's fabric casing (21), the single use installation apparatus (17) is removed. Next, (not illustrated) the entire brassiere is covered with a cotton towel and the area being repaired is pressed with a hot dry iron which allows the outer layer of thermal adhesive (12A) of the repair device (16) to adhere to the inner surfaces of the underwire's fabric casing (22) which eliminates the need to sew. Next, the iron must be removed and the repaired area must be held in place with an unheated section of the cotton towel. Once the repair cools, the cotton towel is removed from the brassiere and the brassiere can be worn. The brassiere will not have an altered outer appearance because the repair device is constructed to be concealed inside the underwire's fabric casing.

Figure 4:
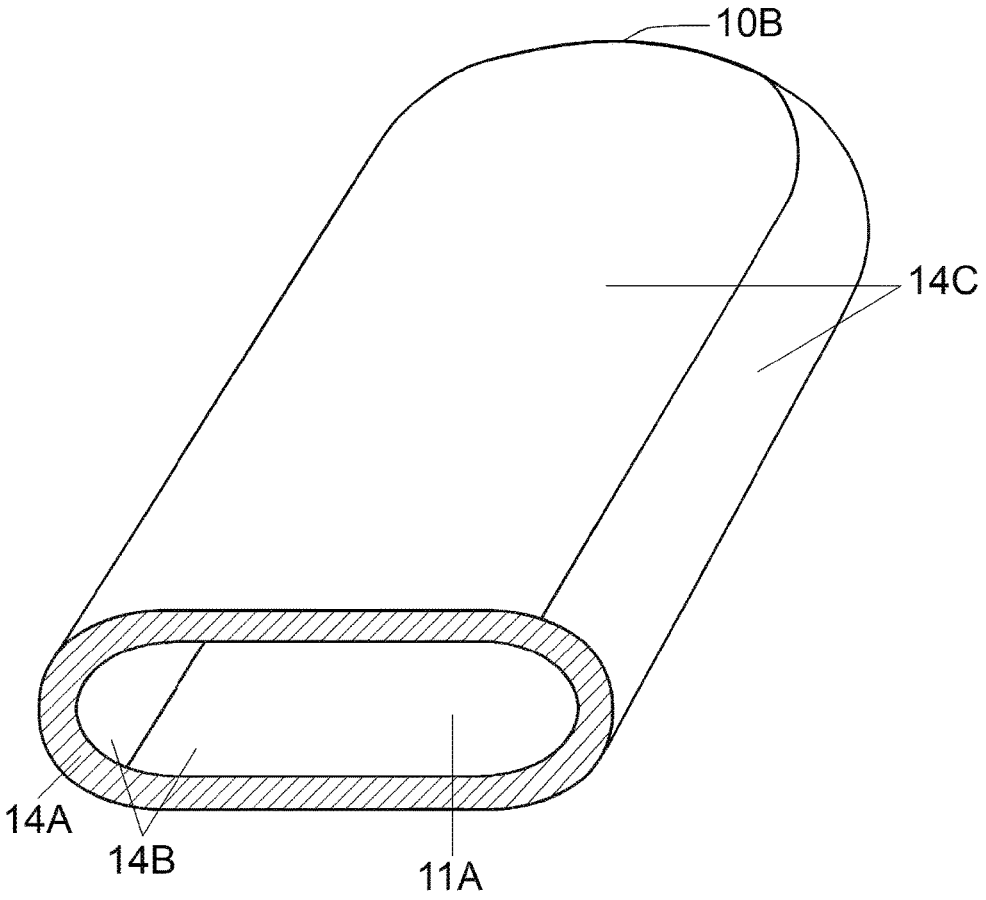
FIG. 4 shows a perspective view of the entire brass sleeve that is used in the first and second embodiments of the repair device. The sleeve is formed into a capped and hollow elliptic cylinder and is represented in FIGS. 1 and 2 by the line shading at its base.
Figure 5:
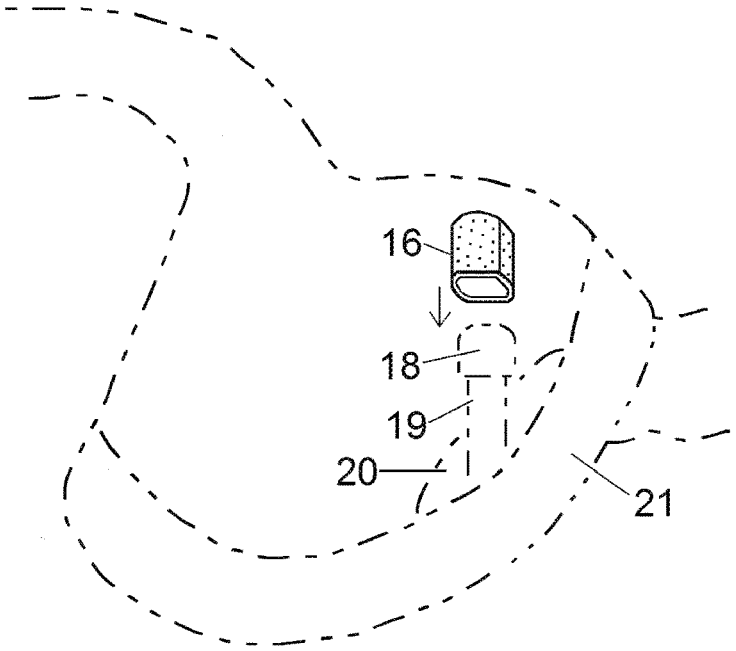
FIGS. 5,6,7,8 (left cup view from the inside of the brassiere) show the operation of use of the repair device and the single use installation apparatus.
Figure 6:
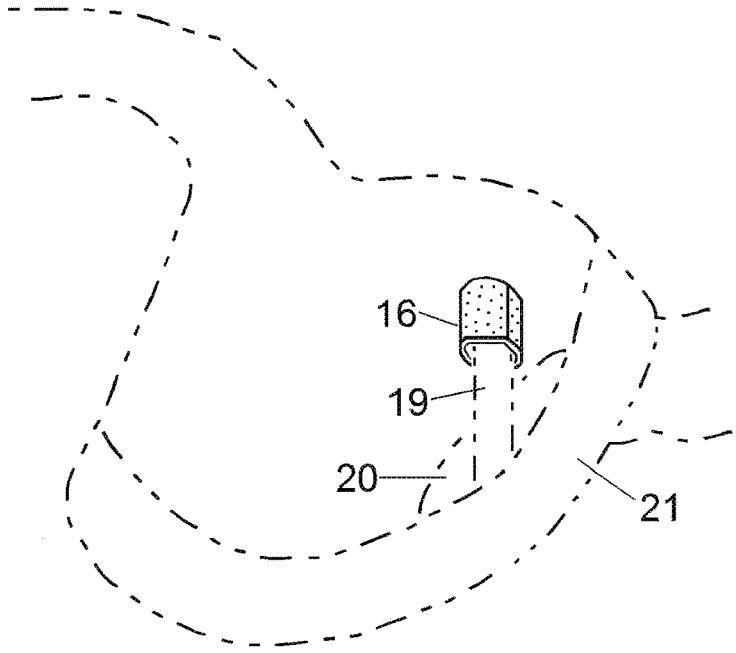

The first embodiment of the repair device is formed into a capped and hollow elliptic cylinder. This embodiment of the repair device has a sleeve (14A) also shown entirely in (FIG. 4) that is made of brass but can also be made of other metals, metal alloys, plastic, wire mesh or from materials that contain nylon, polylactic acid or polyethylene. The base of the repair device shows the sleeve (14A), the oval shaped opening of the sleeve (11A), and the inner surfaces of the sleeve (14B). The top of the repair device (10A) is capped and rounded with thermal adhesive that covers the top of the sleeve (10B) which is capped and rounded. The top of the sleeve (10B) covers and shields the tip (18) of an underwire (19) in order to prevent the underwire from poking through the underwire's fabric casing (21). The oval shaped opening of the sleeve (11A) is suitably sized to receive various thicknesses and shapes of underwire tips. The inner surfaces of the sleeve (14B) cradles a portion of the underwire after the repair device has been fitted over the tip (18) of the underwire (19). The outer surfaces of the sleeve (14C) are smooth but can be textured to provide a superior bonding surface for the outer layer of thermal adhesive (12A). The outer surfaces of the sleeve (14C) has an outer layer of thermal adhesive (12A) applied to it by dipping it into heated thermal adhesive or by insert injection molding. The outer layer of thermal adhesive (12A) adheres to the inner surfaces of an underwire's fabric casing (22). When heated with a hot dry iron, the thickness of the outer layer of thermal adhesive (13) supplies enough thermal adhesive to the inner surfaces of an underwire's fabric casing (22) so that the repair device (16) will remain adhered to the inner surfaces of the underwire's fabric casing (22) after the repaired brassiere has been washed.

Figure 7:
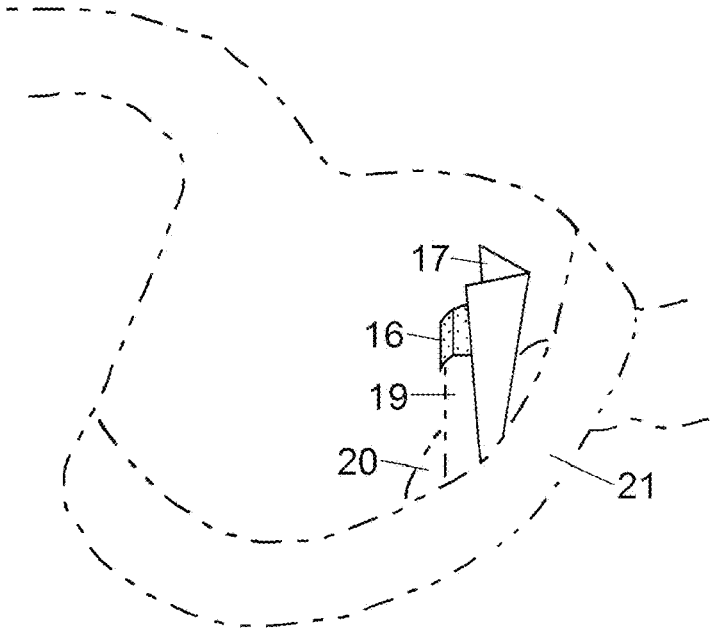
Figure 8:
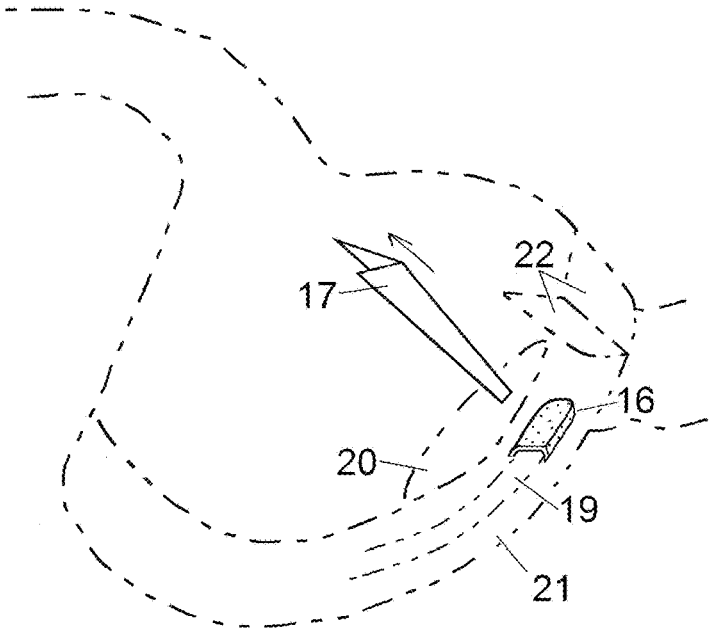

The single use installation apparatus of this invention enables and facilitates the installation of the repair device by reducing friction between the repair device (16) and the inner surfaces of an underwire's fabric casing (22). It is constructed of two mil vinyl sheet but can also be constructed of siliconized paper, regular paper, cardboard, or sheet materials consisting of polyethylene. The single use installation apparatus is formed into a suitably sized inverted isosceles trapezoid and then creased in half longitudinally along its height. As seen in FIGS. 7 and 8, this single use installation apparatus (17) is constructed to fit inside the hole (20) of an underwire's fabric casing (21) and partially surround the repair device (16) and underwire (19). The single use installation apparatus (17) enables and facilitates the installation of the repair device (16) because it provides a slippery surface between the repair device and the inner surfaces of an underwire's fabric casing (22), thereby enabling the repair device (16) and underwire (19) to be fully inserted inside an underwire's fabric casing (21) as shown in (FIG. 8)

Figure 2:
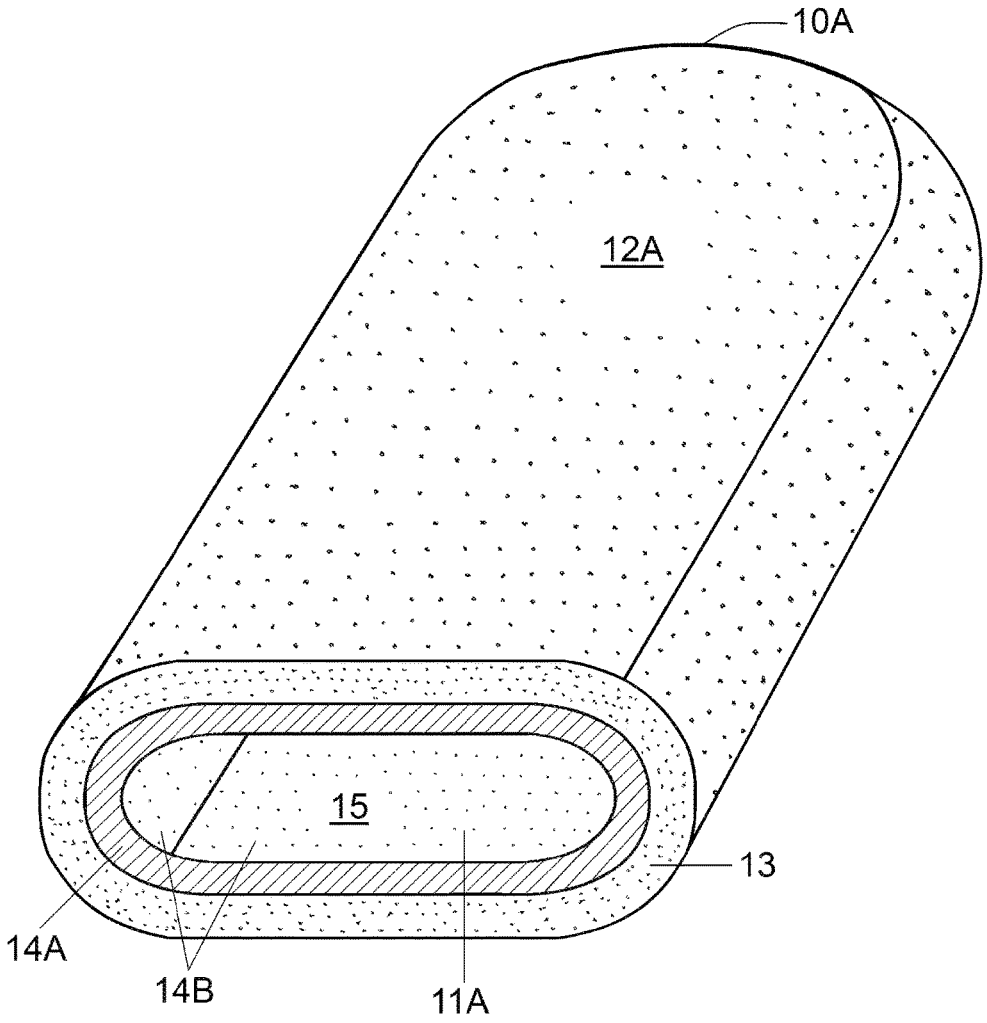
Figure 3:
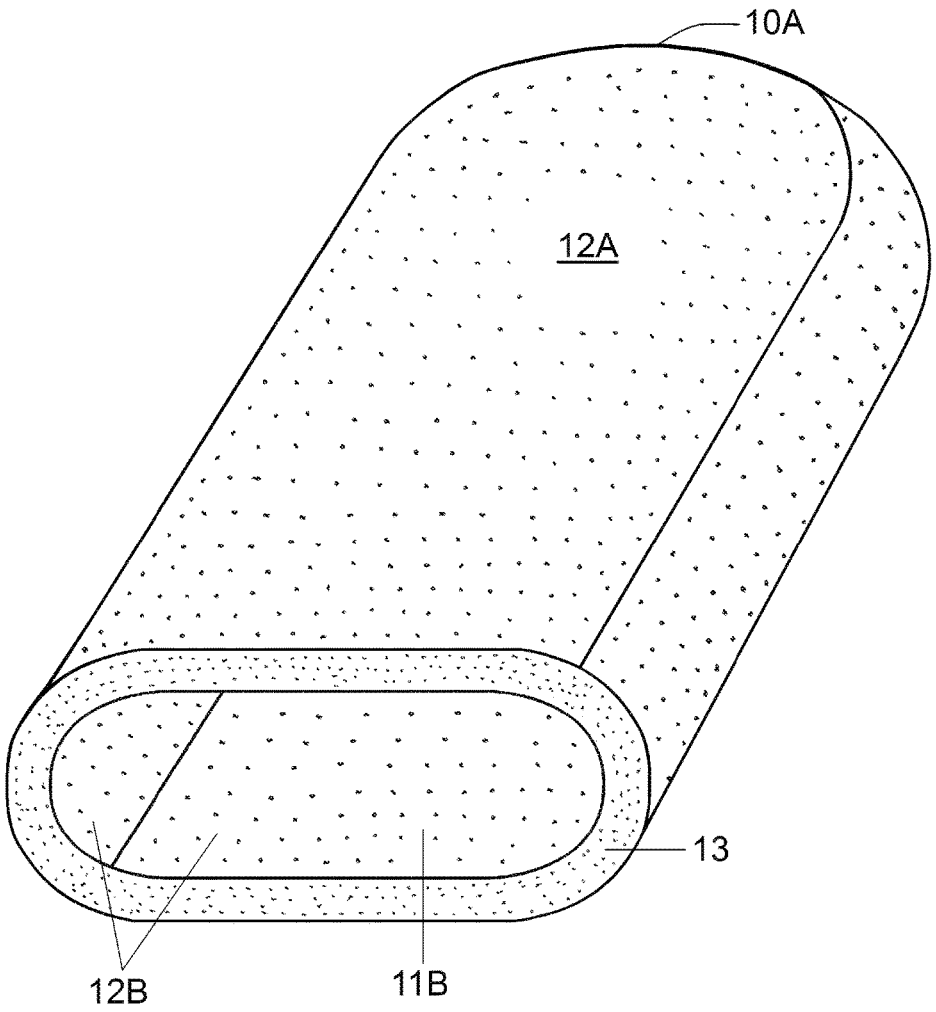

Additional Embodiments of the Repair Device—FIGS. 2 and 3

FIG. 2 shows the second embodiment of the repair device which is similar to the first embodiment of the repair device but has an inner layer of thermal adhesive (15) applied to the inner surfaces of the sleeve (14B). The added inner layer of thermal adhesive (15) adheres to the tip (18) of an underwire (19) thereby restricting movement of the underwire.

FIG. 3 shows the third embodiment of the repair device which is similar to the first embodiment but is constructed entirely of thermal adhesive that is molded into a capped and hollow elliptic cylinder. This embodiment of the repair device is constructed by dipping a siliconized form inside heated thermal adhesive or by insert injection molding and then removing the siliconized form from its outer layer of thermal adhesive (12A) once cooled. The oval shaped opening of the outer layer of thermal adhesive (11B) is flexible and receives various thicknesses and shapes of underwire tips. The absence of the sleeve (FIG. 4) allows this embodiment of the repair device to be fully flexible while being fitted over the tip (18) of an underwire (19). The absence of the sleeve (FIG. 4) also exposes the inner surfaces of the outer layer of thermal adhesive (12B) which adheres to the tip (18) of an underwire (19) thereby restricting movement of the underwire.

CONCLUSIONS, RAMIFICATIONS, AND SCOPE

This invention was created to repair a brassiere or similar garment with an underwire that has poked through its fabric casing, and also to eliminate the aforementioned issues associated with repairing such brassiere. After reading about this invention, one will notice: sewing is not required in order to install the repair device, the single use installation apparatus enables and facilitates the installation of the repair device, the repair device is concealed inside the underwire's fabric casing and does not alter the outer appearance of the brassiere, and the repair device does not require reinstallation after the repaired brassiere has been washed. Further advantages of this invention are:

- The opening of the repair device receives various thicknesses and shapes of underwire tips.
- The inner surfaces of the repair device cradles a portion of the underwire.
- The outer layer of thermal adhesive of the repair device adheres to the inner surfaces of an underwire's fabric casing.
- The capped and rounded top of the repair device's sleeve covers the tip of an underwire and shields it from poking through its fabric casing.

Although the description above contains the first and additional embodiments of this invention, they should not limit the scope of the invention. For example, the repair device and its sleeve can vary in size, the inner and outer thermal adhesive layers can vary in thickness, the opening of the sleeve can formed into various oval shapes, and the sleeve can be made of various materials that bond with thermal adhesive.

The invention claimed is:

1. A system for repairing a brassiere having a fabric casing encompassing an underwire whose end tip section has poked a hole through the fabric casing, said system comprising:

a hollow, elliptic, cylindrically shaped repair sleeve having an open bottom end and an enclosed rounded top end, and an outer layer of thermal adhesive; and an installation apparatus, separate and independent from the repair sleeve, whereby the repair sleeve is configured to fit over the end tip section of the underwire and the installation apparatus is configured to be installed into the hole between the repair sleeve and an inner surface of the fabric casing to facilitate the installation of the repair sleeve entirely within the fabric casing.

2. The system as in claim 1 wherein the repair sleeve comprises an outer sleeve and a hollow elliptic, cylindrically shaped inner sleeve located within the outer sleeve.

3. The system as in claim 2 wherein an inner layer of thermal adhesive is located within the inner sleeve.

4. The system as in claim 2 wherein the inner sleeve is made of brass or other metal materials, metal mesh or metal alloy.

5. The system as in claim 2 wherein the inner sleeve is made of plastic or any one of nylon polylactic acid or polyethylene material.

6. The system as in claim 1 wherein the installation apparatus comprises a material having a slippery surface which is configured to reduce friction between the sleeve and the fabric casing.

7. The system as in claim 1 wherein the installation apparatus comprises a vinyl sheet which is configured to reduce the friction between the sleeve and the fabric casing.

8. The system as in claim 1 wherein the installation apparatus comprises a paper or any one of cardboard, vinyl sheet material, siliconized paper or polyethylene material which is configured to reduce the friction between the sleeve and the fabric casing.

9. The system as in claim 1 wherein the installation apparatus is shaped as an inverted isosceles trapezoid, folded longitudinally in half.

10. The method for repairing a brassiere having an outer fabric casing encompassing an underwire whose end tip section has poked a hole through the fabric casing, the method comprising the steps of:

providing a repair sleeve having an open bottom end and an enclosed rounded top end and an outer layer of thermal adhesive;

providing an installation appliance configured to reduce friction between the repair sleeve and an inner surface of the fabric casing;

fitting the repair sleeve over the end tip section of the underwire;

positioning the installation apparatus into the poked hole in the fabric casing, between the repair sleeve which is fitted over the end tip section and the inner surface of the fabric casing;

inserting the repair sleeve which is fitted over the end tip section down the installation apparatus and inside the fabric casing such that the repair sleeve is entirely covered by the fabric casing;

removing the installation apparatus;

applying heat arid pressure to the fabric casing in the area in which the repair sleeve is fully covered;

allowing h outer layer of thermal adhesive of the repair sleeve to adhere to the fabric casing; and allowing the area in which the repair sleeve is fully covered to cool.

* * * * *